US008579141B2

(12) United States Patent
Tejima et al.

(10) Patent No.: US 8,579,141 B2
(45) Date of Patent: Nov. 12, 2013

(54) FITTING STRUCTURE FOR TWO MEMBERS

(71) Applicant: Kabushiki Kaisha Tokai Rika Denki Seisakusho, Aichi (JP)

(72) Inventors: Akihito Tejima, Aichi (JP); Hiroaki Yamaguchi, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 13/648,370

(22) Filed: Oct. 10, 2012

(65) Prior Publication Data

US 2013/0092692 A1 Apr. 18, 2013

(30) Foreign Application Priority Data

Oct. 13, 2011 (JP) ..... 2011-225770

(51) Int. Cl.
*B65D 45/16* (2006.01)

(52) U.S. Cl.
USPC ..... 220/326; 215/230; 24/589.1

(58) Field of Classification Search
USPC ..... 220/326, 324, 315, 323, 377; 383/106; 215/230; 24/704.1, 589.1, 614, 615
See application file for complete search history.

(56) References Cited

U.S. PATENT DOCUMENTS 5,234,124 A * 8/1993 Buckner et al. ..... 220/326
5,931,514 A * 8/1999 Chung ..... 292/89
5,944,210 A * 8/1999 Yetter ..... 220/4.21
5,947,321 A * 9/1999 Vadney ..... 220/367.1
6,318,585 B1 * 11/2001 Asagiri et al. ..... 220/788

FOREIGN PATENT DOCUMENTS

JP 2011-101543 5/2011

* cited by examiner

*Primary Examiner* — J. Gregory Pickett
*Assistant Examiner* — James Way
(74) *Attorney, Agent, or Firm* — Morgan, Lewis & Bockius LLP

(57) ABSTRACT

A fitting structure for two members includes a body and a lid member. The body includes an open space portion therein, a closed portion closing the open space portion, a fitting portion provided at the open space portion, and a front face. The lid member includes an elastic claw portion. A window portion is provided on the closed portion. A tip portion of the elastic claw portion is viewed through the window portion in a direction opposite to the fitting direction of the lid member to the body under a condition that the lid member is attached to the body. A fitting confirmation portion is provided at a peripheral edge portion of the window portion and indicates position of the tip portion of the elastic claw portion fitted to the fitting portion at a regular fitting position.

3 Claims, 3 Drawing Sheets

FITTING STRUCTURE FOR TWO MEMBERS

BACKGROUND

The present disclosure relates to a fitting structure for two members, which is adapted to fit a lid member to a body.

It has been usual to attach a lid member to a body in a fitted state by engaging fitting an elastic claw portion provided on the lid member to a fitting portion provided on the body.

Meanwhile, in order to prevent the lid member from rattling when the lid member is attached to the body in the fitted state, the elastic claw portion is to be fitted to the fitting portion under a condition that the lid member is press-fitted into the body. Therefore, even in a case where the elastic claw portion is in a half-fitted state with respect to the fitting portion when the lid member is attached to the body, it appears from the outside that the lid member is attached to the body in the fitted state.

In order to solve the above problem, JP-A-2011-101543 discloses that a window portion is provided on the body, and the fitted state of the elastic claw portion with respect to the fitting portion is confirmed through the window portion.

However, with the configuration disclosed in JP-A-2011-101543, it is sometimes hard to confirm at a glance that the elastic claw portion is in a half-fitted state with respect to the fitting portion. That is, even in the half-fitted state, it is sometimes hard to confirm at a glance that the elastic claw portion is in the half-fitted state depending on a position of the elastic claw portion which is in the half-fitted state with respect to the fitting portion. Therefore, in a case where the elastic claw portion is not fitted to the fitting portion at a regular position, the elastic claw portion may come off from the fitting portion upon receiving, for example, impact so that the lid member possibly comes off from the body.

SUMMARY

The present disclosure is made in view of the above circumstances, and the purpose of the present disclosure is to provide a fitting structure for two members that makes it possible to readily confirm that an elastic claw portion of a lid member is fitted to a fitting portion of a body at a regular position in a structure that the lid member is attached to the body by fitting the elastic claw portion of the lid member to the fitting portion of the body.

In order to achieve the above object, according to the present disclosure, there is provided a fitting structure for two members, comprising:

a body that includes an open space portion therein, a closed portion closing the open space portion at rear side, a fitting portion provided at the open space portion, and a front face having an opening which communicates to the open space portion;

a lid member that includes an elastic claw portion projected in a fitting direction of the lid member to the body, and is attached to the body in a fitted state so as to close the open space portion by fitting the elastic claw portion to the fitting portion; and a window portion provided on the closed portion, wherein a tip portion of the elastic claw portion is viewed through the window portion in a direction opposite to the fitting direction of the lid member to the body under a condition that the lid member is attached to the body; and wherein a fitting confirmation portion is provided at a peripheral edge portion of the window portion and indicates a position of the tip portion of the elastic claw portion fitted to the fitting portion at a regular fitting position.

For example, the fitting confirmation portion is formed on an inner peripheral face of the window portion, and forms recess portion concaved in a width direction of the elastic claw portion fitted to the fitting portion at the regular fitting position.

For example, a width dimension of the recess portion is the same as a thickness dimension of the elastic claw portion in a thickness direction of the elastic claw portion perpendicular to the width direction of the elastic claw portion.

In accordance with the above configuration, when the lid member is attached to the body, the elastic claw portion of the lid member is fitted to the fitting portion of the body, and the fitted state can be confirmed through the window portion provided on the closed portion of the body. At that time, when the elastic claw is in a half-fitted state with respect to the fitting portion so as to be in a bent state, a tip portion of the elastic claw portion is shifted from a regular fitting position indicated by the fitting confirmation portion. Consequently, it is possible to readily confirm whether or not the elastic claw portion is fitted to the fitting portion at the regular position.

BRIEF DESCRIPTION OF THE DRAWINGS

The above objects and advantages of the present disclosure will become more apparent by describing in detail preferred exemplary embodiments thereof with reference to the accompanying drawings, wherein.

DETAILED DESCRIPTION OF EXEMPLARY EMBODIMENTS

A fitting structure for two members according to an embodiment of the present disclosure is described below with reference to accompanying drawings.

Figure 1:
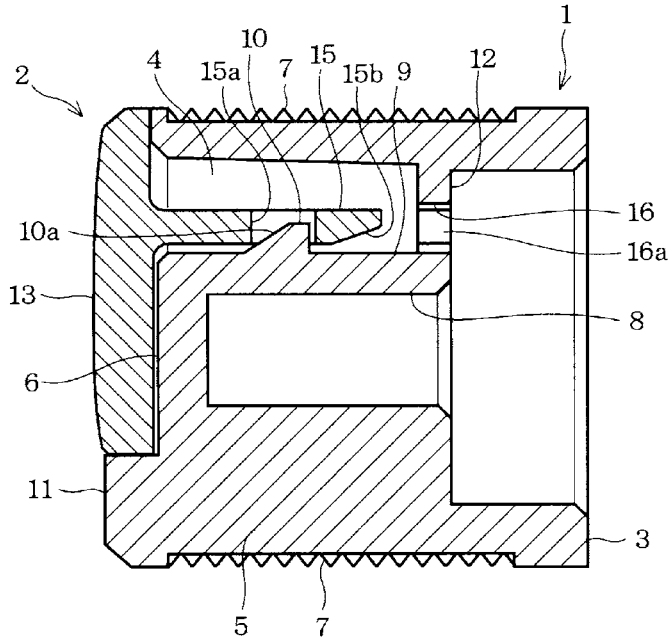
FIG. 1 is a vertical cross-sectional side view illustrating a knob in an attached state of a cap according to an embodiment of the present disclosure.
Figure 2:
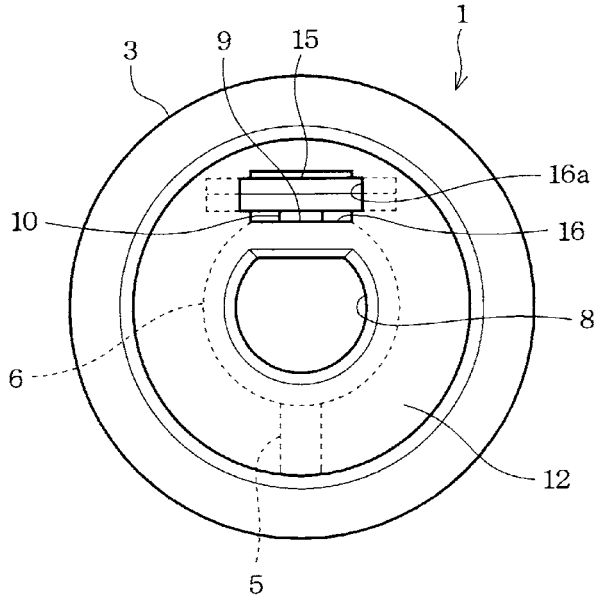
FIG. 2 is a rear view illustrating the knob in the attached state of the cap.
Figure 3:
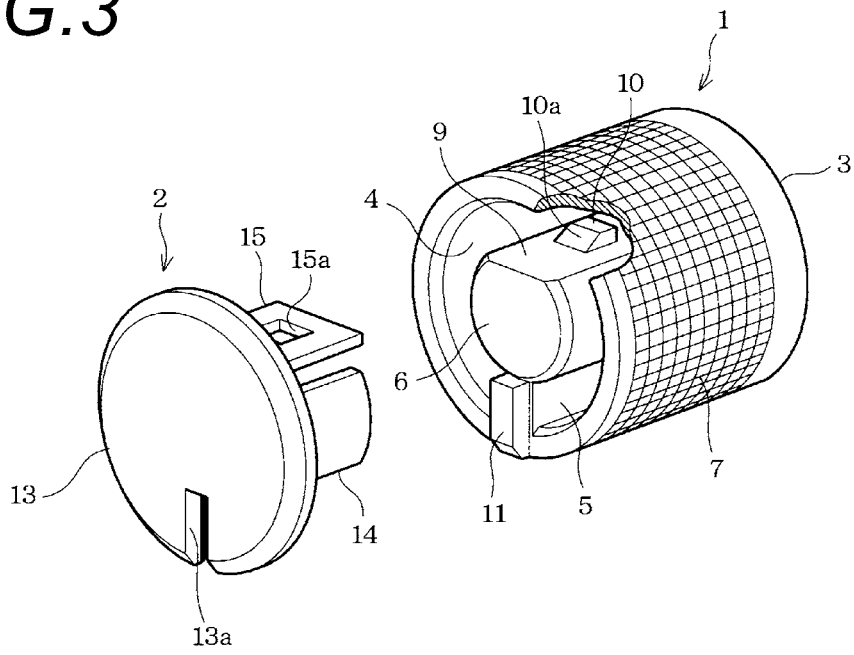
FIG. 3 is an exploded perspective view illustrating the cap and the knob.
Figure 4:
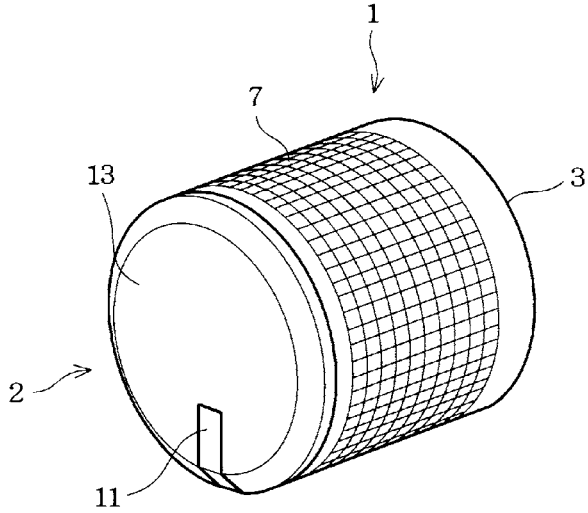
FIG. 4 is a perspective view illustrating the knob in the attached state of the cap.

FIG. 1 is a vertical cross-sectional side view illustrating a knob in an attached state of a cap, FIG. 2 is a rear view illustrating the knob in the attached state of the cap, FIG. 3 is an exploded perspective view illustrating the cap and the knob, and FIG. 4 is a perspective view illustrating the knob in the attached state of the cap. A knob 1 (corresponding to a body) is attached to a shaft of a volume for adjusting temperature of, for example, a sheet heater switch (not shown), and the knob 1 is adapted to control a temperature of warm air blowing out from an inner part of a sheet by a rotational operation of the sheet heater switch. A cap 2 (corresponding to a lid member) functions as a lid member and a designing member by being attached to a front face of the knob 1.

First, the knob 1 is described below. The knob 1 is made of a resin and is constituted such that an open space portion 4 is formed on a circular cylindrical shaped grip portion 3 at an inner peripheral side and a boss portion 6 which is supported by an inner peripheral face of the grip portion 3 and a coupling portion 5 is placed in the open space portion 4. The grip portion 3 is provided with a knurled portion 7 having both of an anti-slippage function and a designing function at its outer peripheral face. An insertion hole portion 8 through which the shaft of the volume for adjusting temperature (not shown) is inserted from a rear face side is formed on the boss portion 6, and its shape corresponds to a shape of the shaft of the volume for adjusting temperature formed by a flat chamfering process. Meanwhile, a spring (not shown) is attached to the boss portion 6, and retaining of the inserted shaft is achieved by the spring.

A flat face section 9 is formed on the boss portion 6 in an outer peripheral face at a part corresponding to the flat chamfering processed portion of the shaft, and a projection shaped fitting portion 10 having an inclined face portion 10*a* extending along an axial direction of the boss portion 6 is formed on the flat face section 9. An indication portion 11 is formed so as to be projected, in an end face at a front face side, on the coupling portion 5 which couples the grip portion 3 to the boss portion 6. The indication portion 11 is adapted to indicate a rotational position of the grip portion 3.

Next, the cap 2 is described below. The cap 2 is formed of a resin having translucency, and a plurality of holding portions 14 are integrally formed with the cap 2 on its disc shaped designing section 13 at a rear face thereof such that the holding portions 14 are projected to the rear face side, i.e., in a fitting direction toward the knob 1. The inner peripheral sides of the holding portions 14 are formed in shapes corresponding to the outer peripheral face of the boss portion 6, and each of the holding portions 14 is held by the boss portion 6 in an aligned state under a condition that the cap 2 is attached to the knob 1. A flat plate shaped elastic claw portion 15 is integrally formed with the cap 2 so as to be projected toward the rear face side at a part corresponding to the flat face section 9 of the boss portion 6. A hole portion 15*a* is formed on the elastic claw portion 15 at its tip portion and an inclined face portion 15*b* is formed on the tip portion at a part facing the flat face section 9 of the boss portion 6. When the cap 2 is attached to the knob 1, the inclined face portion 15*b* of the elastic claw portion 15 slides on the inclined face portion 10*a* of the fitting portion 10, and thereby the elastic claw portion 15 becomes in a bent state so that the hole portion 15*a* of the elastic claw portion 15 is to be finally fitted to the fitting portion 10. In this case, the elastic claw portion 15 is set in such a manner that the elastic claw portion 15 is fitted to the fitting portion 10 at a position slightly away from the flat face section 9 of the boss portion 6. This is because that in a case where the elastic claw portion 15 is set so as to be intimately fitted to the flat face section 9, the elastic claw portion 15 is sometime pushed by the flat face section 9 so as to be bent, and in this case, the fitting of the elastic claw portion 15 to the fitting portion 10 possibly becomes incomplete.

A slit 13*a* is formed on the designing section 13, and by fitting the slit 13*a* to the indication portion 11 of the knob 1, the designing section 13 and the indication portion 11 are united with each other. In the above case, the indication portion 11 is formed in a shape corresponding to the shape of the designing section 13, and the designing section 13 and the indication portion 11 are flush with each other under a condition that the slit 13*a* is fitted to the indication portion 11. In addition, a small knob orienting in the fitting direction of the indication portion 11 is formed on the slit 13*a* at the inner side, and the slit 13*a* is fitted to the indication portion 11 of the knob 11 in a press fitted state under a condition that the cap 2 is fitted to the indication portion 11.

Here, the rear face side of the boss portion 6 is closed by a closed portion 12, and a rectangular shaped window portion 16 that passes through the closed portion 12 is formed on the closed portion 12 at a part corresponding to a rear face of the fitting portion 10. The window portion 16 is provided for visually confirming a fitted state of the elastic claw portion 15 of the knob 1 fitted to the fitting portion 10 provided on the flat face section 9. That is, a concave shaped recess portion 16*a* (corresponding to a fitting confirmation portion) is formed on a part of the inner peripheral face of the window portion 16 in the width direction of the elastic claw portion 15. The recess portion 16*a* is formed in a shape indicating a position of the elastic claw portion 15 fitted to the fitting portion 10 at a regular fitting position, and the width dimension T of the recess portion 16*a* is the same as a thickness dimension of the elastic claw portion 15.

Meanwhile, a light guiding portion (not shown) is provided on a rear face side of the boss portion 6, and thereby the indication portion 11 is illuminated by light from the light guiding portion when a light source is activated.

Next, an operation of the above structure for the lid member and the body is described below. When the cap 2 is attached to the knob 1, the cap 2 is pressed into the knob 1 so as to allow the holding portions 14 of the cap 2 to hold the boss portion 6 of the knob 1 under a condition that the slit 13*a* of the cap 2 and the indication portion 11 of the knob 1 are aligned with each other. With this, the holding portions 14 of the cap 2 advance while holding the boss portion 6 of the knob 1. Along with the advancing of the holding portions 14, the inclined face portion 15*b* of the elastic claw portion 15 at the tip portion thereof slides on the inclined face portion 10*a* of the fitting portion 10 so that the elastic claw portion 15 is bent toward a side opposite to the flat face section 9 of the boss portion 6. When the slit 13*a* of the cap 2 is strongly press-fitted into the indication portion 11 of the knob 1, the hole portion 15*a* of the elastic claw portion 15 rides over the fitting portion 10 so as to allow the hole portion 15*a* to be fitted to the fitting portion 10. Therefore, the cap 2 can be attached to the knob 1 in the fitted state. In the fitted state, the open space portion 4 of the knob 1 is completely covered by the cap 2.

The slit 13*a* of the cap 2 is press-fitted into the indication portion 11 of the knob 1 as in the above description. Therefore, even when the hole portion 15*a* of the elastic claw portion 15 becomes in a half-fitted state in which the hole portion 15*a* of the elastic claw portion 15 is not completely fitted to the fitting portion 10 of the boss portion 6, it appears as if the cap 2 is attached to the knob 1 in the fitted state from the outside. However, in that half-fitted state, the cap 2 may possibly come off from the knob 1 by an impact.

Consequently, the fitted state of the elastic claw portion 15 to the fitting portion 10 is confirmed through the window portion 16 provided on the closed portion 12 in viewed from the rear face side of the knob 1.

Figure 5:
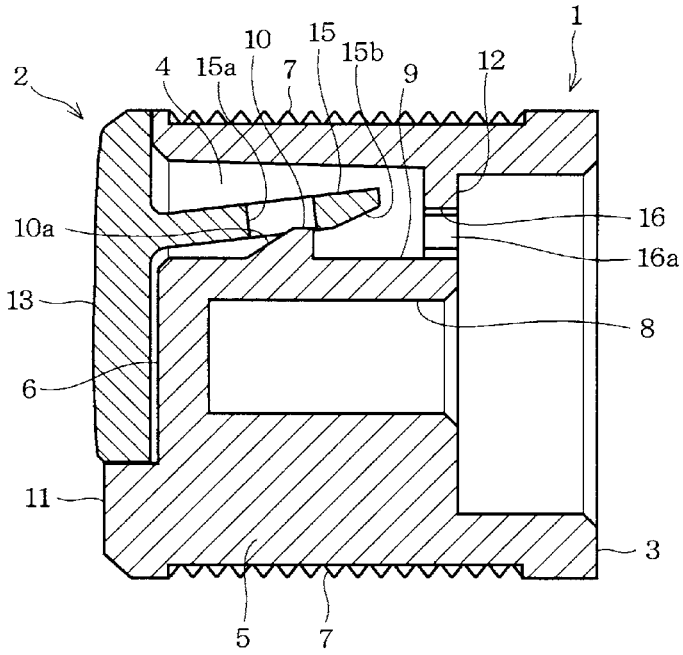
FIG. 5 is a vertical cross-sectional side view illustrating the knob in a half-fitted state of the cap.
Figure 6:
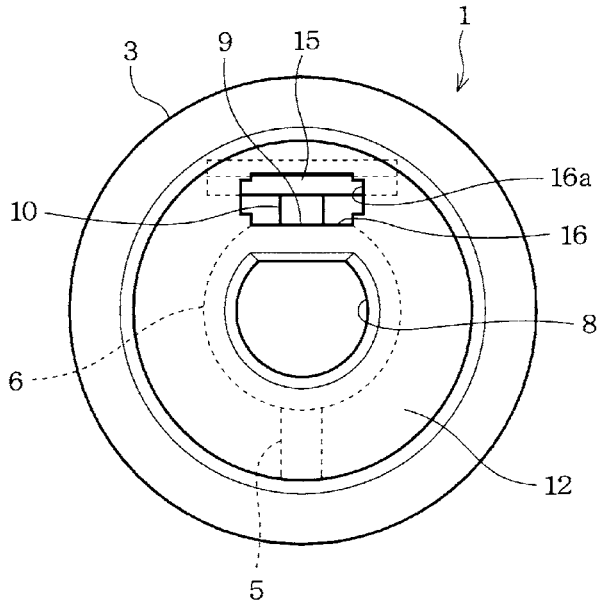
FIG. 6 is a rear view illustrating the knob in the half-fitted state of the cap.

FIG. 5 is a vertical cross sectional view illustrating the attached state in which the cap 2 is attached to the knob 1 in the half-fitted state, and FIG. 6 is a back side view illustrating the half-fitted state. In a case where the hole portion 15*a* of the elastic claw portion 15 is in the half-fitted state with respect to the fitting portion 10 of the boss portion 6 and the elastic claw portion 15 is bent, the tip portion of the elastic claw portion 15 is seen at a position out of the recess portion 16*a* of the hole portion 15*a*. Contrary to the above, in a case where the hole portion 15*a* of the elastic claw portion 15 is fitted to the fitting portion 10 of the boss portion 6 at the regular position as illustrated in FIGS. 1 and 2, the tip portion of the elastic claw portion 15 is seen at a position coincident with the recess portion 16*a* of the window portion 16. With this, it is possible to readily confirm whether or not the hole portion 15*a* of the elastic claw portion 15 is fitted to the fitting portion 10 of the boss portion 6 at the regular position. In this case, the width dimension T of the recess portion 16*a* is the same as the thickness dimension of the elastic claw portion 15. Therefore, in a case where the hole portion 15*a* of the elastic claw portion 15 is fitted to the fitting portion 10 of the boss portion 6 at the regular position, the elastic claw portion 15 becomes completely coincident with the recess portion 16*a*. As a result, based on the above, it is possible to surely confirm whether or not the hole portion 15*a* of the elastic claw portion 15 is fitted to the fitting portion 10 of the boss portion 6 at the regular position.

In a case where it is confirmed that the hole portion 15*a* of the elastic claw portion 15 is in the half-fitted state with respect to the fitting portion 10 of the boss portion 6 based on the result of the above described confirmation, a process in which the cap 2 is further pressed into the knob 1 and the fitted state is reconfirmed through the window portion 16, is to be repeated. Thus, the cap 2 can be surely attached to the knob 1 in the fitted state.

In accordance with the above embodiment, the following advantages can be achieved. Since the window portion 16 through which the tip position of the elastic claw portion 15 to be fitted to the fitting portion 10 can be visually confirmed under a condition that the cap 2 is attached to the knob 1, is provided on the closed portion 12 that closes the knob 1 at the rear face side, it is possible to readily confirm whether or not the elastic claw portion 15 is fitted to the fitting portion 10 at the regular position.

Since the recess portion 16*a* is formed in a shape so as to be concaved in the width direction of the elastic claw portion 15, it is possible to readily confirm a positional relationship with respect to the elastic claw portion 15.

Since the width dimension T of the recess portion 16*a* and the thickness dimension of the elastic claw portion 15 are the same, it is possible to confirm at a glance whether or not the elastic claw portion 15 is fitted to the fitting portion 10 at the regular position.

(Another Embodiment)

The present disclosure is not limited to the above described embodiment, and the following modification or expansion can be made.

It is possible that a hook portion instead of the hole portion 15*a* is formed on the elastic claw portion 15 at the tip portion, a hole-shaped fitting portion instead of the projection-shaped fitting portion 10 is formed on the boss portion 6, and thereby the hook portion of the elastic claw portion 15 may be fitted to the hole-shaped fitting portion.

The width dimension of the recess portion 16*a* is not necessarily the same as the thickness dimension of the elastic claw portion 15, but it is enough to be able to confirm whether or not the elastic claw portion 15 is fitted to the fitting portion 10 at the regular position.

Although the present disclosure has been illustrated and described for the particular preferred embodiments, it is apparent to a person skilled in the art that various changes and modifications can be made on the basis of the teachings of the present disclosure. It is apparent that such changes and modifications are within the spirit, scope, and intention of the present disclosure as defined by the appended claims.

The present application is based on Japanese Patent Application No. 2011-225770 filed on Oct. 13, 2011, the contents of which are incorporated herein by reference.

What is claimed is:

1. A fitting structure for two members, comprising:

a body that includes an open space portion therein, a closed portion closing the open space portion at a rear side, a fitting portion provided at the open space portion, and a front face having an opening which communicates to the open space portion;

a lid member that includes an elastic claw portion projected in a fitting direction of the lid member to the body, and is attached to the body in a fitted state so as to close the open space portion by fitting the elastic claw portion to the fitting portion; and a window portion provided on the closed portion, wherein a tip portion of the elastic claw portion is viewed through the window portion, in a direction opposite to the fitting direction of the lid member to the body, under a condition that the lid member is attached to the body; and wherein a fitting confirmation portion is provided at a peripheral edge portion of the window portion, and indicates a position of the tip portion of the elastic claw portion fitted to the fitting portion at a regular fitting position;

and wherein a hole portion is formed on the elastic claw portion; and wherein the fitting portion is fitted in the hole portion of the elastic claw portion.

2. The fitting structure for two members according to claim 1, wherein the fitting confirmation portion is formed on an inner peripheral face of the window portion and forms a concave recess portion in a width direction of the elastic claw portion fitted to the fitting portion at the regular fitting position.

3. The fitting structure for two members according to claim 2, wherein a width dimension of the recess portion is the same as a thickness dimension of the elastic claw portion, in a thickness direction of the elastic claw portion perpendicular to the width direction of the elastic claw portion.

* * * * *